US009669907B2

(12) United States Patent
Field

(10) Patent No.: US 9,669,907 B2
(45) Date of Patent: Jun. 6, 2017

(54) RETRACTABLE SPORT BOARD RACK SYSTEM

(71) Applicant: Steven Field, Port Orange, FL (US)

(72) Inventor: Steven Field, Port Orange, FL (US)

( * ) Notice: Subject to any disclaimer, the term of this patent is extended or adjusted under 35 U.S.C. 154(b) by 0 days.

(21) Appl. No.: 15/084,921

(22) Filed: Mar. 30, 2016

(65) Prior Publication Data

US 2016/0296821 A1 Oct. 13, 2016

Related U.S. Application Data

(60) Provisional application No. 62/143,940, filed on Apr. 7, 2015.

(51) Int. Cl.

| | |
|---|---|
| ***A47F 7/00*** | (2006.01) |
| ***B63B 35/79*** | (2006.01) |
| ***A47B 43/00*** | (2006.01) |

(52) U.S. Cl.

CPC ..... *B63B 35/7946* (2013.01); *A47B 43/006* (2013.01)

(58) Field of Classification Search

CPC ..... F25C 5/005; F25D 23/028; A47B 43/006; A47B 43/003; A47B 51/00; B63B 35/7946

See application file for complete search history.

(56) References Cited

U.S. PATENT DOCUMENTS

| | | | | | |
|---|---|---|---|---|---|
| 1,191,998 | A * | 7/1916 | Riordan | A43D 117/00 | 211/119.17 |
| 1,225,607 | A * | 5/1917 | Ford et al. | A47B 43/006 | 108/149 |
| 1,602,771 | A * | 10/1926 | Mitchell | A47B 51/00 | 108/164 |
| 3,157,155 | A * | 11/1964 | Duntley | A01K 31/002 | 119/455 |
| 3,572,251 | A * | 3/1971 | Johnson | A47G 25/54 | 104/89 |
| 3,901,165 | A * | 8/1975 | Schlesinger | A47B 43/006 | 108/149 |

(Continued)

FOREIGN PATENT DOCUMENTS

AU 2008080186 * 7/2008

*Primary Examiner* — Leslie A Nicholson, III
*Assistant Examiner* — Kimberley S Wright
(74) *Attorney, Agent, or Firm* — Allen, Dyer, Doppelt & Gilchrist

(57) ABSTRACT

A sports board rack system includes an upper support frame, an upper pulley arrangement carried by the upper support frame, a lower support frame, and a lower pulley arrangement carried by the lower support frame. A flexible rack assembly is coupled between the upper and lower support frames and includes a pair of spaced apart rack units. Each rack unit includes spaced apart board supports. The upper and lower pulley arrangements are coupled together so that the flexible rack assembly is moveable between an expanded position and a retracted position. In the expanded position the board supports are aligned with one another in a horizontal direction for placement and removal of sports boards. In the retracted position the board supports are moved closer to one another so that a separation distance between adjacent board supports in a vertical direction is reduced.

17 Claims, 4 Drawing Sheets

(56) References Cited

U.S. PATENT DOCUMENTS 4,061,092 A * 12/1977 Jacobsen ..... A47B 43/006 108/149
4,187,787 A * 2/1980 Nakatsu ..... A47B 43/006 108/106
4,295,432 A * 10/1981 Hulke ..... A47B 43/006 108/149
4,329,789 A * 5/1982 Erickson ..... F26B 25/18 108/164
D270,977 S * 10/1983 Kneale, III ..... D6/514
4,523,526 A * 6/1985 O'Neill ..... A47B 43/006 108/149
4,884,935 A * 12/1989 Smith ..... B61B 3/00 108/149
5,141,116 A 8/1992 Mojica
5,195,426 A * 3/1993 Thuli ..... B65G 49/085 118/425
5,211,296 A * 5/1993 D'Heygere ..... B65G 1/026 211/1.57
5,833,079 A 11/1998 Roberts
5,950,844 A * 9/1999 Taylor ..... A47B 43/00 211/118
6,595,145 B1 * 7/2003 Lietz ..... A47B 43/006 108/106
6,814,418 B2 * 11/2004 D'Orso ..... A47B 61/04 108/149
7,810,655 B2 * 10/2010 Wang ..... A47B 43/006 108/149
8,075,237 B2 * 12/2011 Webster ..... E04H 6/18 187/205
8,701,901 B2 * 4/2014 Gregory ..... A47B 43/006 108/149
D725,399 S * 3/2015 Wang ..... D6/514
9,266,674 B2 * 2/2016 Reimer ..... B65G 1/026
2003/0164347 A1 9/2003 Bouvier, Jr.
2005/0023229 A1 * 2/2005 Ashley ..... A47B 61/00 211/38
2006/0103280 A1 * 5/2006 Kubota ..... A47B 43/006 312/348.5
2007/0114196 A1 * 5/2007 Cameron ..... A47G 25/02 211/113
2010/0117499 A1 * 5/2010 Fortier ..... A45C 7/0031 312/306
2012/0111816 A1 * 5/2012 Mathews ..... A47B 43/006 211/90.02
2013/0032560 A1 * 2/2013 Gregory ..... A47B 43/006 211/153
2014/0001133 A1 * 1/2014 Shaghafi ..... A47B 43/003 211/85.7
2014/0311995 A1 * 10/2014 Reimer ..... B65G 1/026 211/1.57
2015/0230670 A1 * 8/2015 Pan ..... A47K 10/04 211/16

* cited by examiner

RETRACTABLE SPORT BOARD RACK SYSTEM

RELATED APPLICATIONS

This application claims the benefit of U.S. Provisional Application Ser. No. 62/143,940 filed Apr. 7, 2015, the entire contents of which are incorporated herein by reference.

FIELD OF THE INVENTION

The present invention relates to storage racks, and more particularly, to an overhead storage rack for storing sports boards including surfboards, wakeboards, snowboards, skis, for example.

BACKGROUND OF THE INVENTION

Sports boards are widely used by today's active outdoor athletes and sports enthusiasts. Sports boards include surfboards, wakeboards, wakeboards, water skis and snow skis, for example. When sports boards are not in use, storage is generally a problem due to their relatively large sizes, particularly for surfboards.

With respect to surfboards, for example, it is common for a surfboard to be stored in an upright standing position along a wall or laying flat on the floor. For either one of these storage approaches, the surfboard is susceptible to being knocked to the ground or being bumped into by other objects.

This problem is compounded when a surfer typically owns multiple boards to accommodate different wave conditions. Surfboards have evolved from one size fits all to now being tailored to match the intricacies of a board to the intricacies of the waves. This can be done by selecting design variations in the length, thickness, template, fins, rocker curves and bottom contours (i.e., flat or concave) of the surfboard.

The construction of a typical surfboard is that of fiberglass laminated to foam. While a surfboard is strong and resilient to blunt distributed forces subjected to in normal use, the surfboard is very susceptible to damage by sharp focused blows as would be incurred by being hit or falling to the ground. As most surfboards are about 6 feet in length or longer and roughly two feet wide, storage of multiple fragile objects of this size becomes intrusive to a living or work space.

One approach for storing surfboards is disclosed in U.S. Pat. No. 5,141,116 to Mojica. The '116 patent discloses a rack that holds the boards in a vertical orientation. The rack has a main rack section that is serpentine in shape. The curves in the rack establish storage bays. Each storage bay has an arcuate central wall and outwardly diverging sides for holding a surfboard in place. Brackets are attached to the free ends of the rack to permit mounting the rack on a wall. If desired, one or more curved extension pieces can be connected to the free ends of the rack to permit storing additional surfboards.

Another approach for storing surfboards is disclosed in U.S. Pat. No. 5,833,079 to Roberts. The '079 patent discloses spaced apart rack units to be attached to a substantially vertical surface so that the surfboards are held in a horizontal orientation. Each rack unit includes a base from which protrudes at least one strut member, and a strut retaining portion attached to the base, and from which each strut member protrudes. Each pair of spaced apart strut members are canted upwardly from 4 to 20 degrees above horizontal to hold a surfboard in place.

As an alternative to storing surfboards along a wall, an overhead storage rack is disclosed in U.S. Published Patent No. 2003/0164347 to Bouvier, Jr. The overhead storage rack includes multiple pairs of elongated rigid rollers spaced apart and supported by flexible webbing hung from rafters or a ceiling. The webbing may be adjustable in length. The rollers have a rubberized coating to assist with loading, unloading and storing of surfboards or other long objects.

A common design shared among the above racks is the use of a fixed or stationary support mechanism to hold multiple surfboards. This type of design tends to be less than ideal when taking into consideration space constraints where the racks may be mounted. Consequently, there is a need for a sports board rack that reduces the amount of space needed for storing surfboards.

SUMMARY OF THE INVENTION

The present invention comprises a modular retractable storage rack for sports boards. The invention is configured to be mounted in an overhead hanging position from a brace system preferably mounted either on wall studs or ceiling rafters. The rack allows for boards to be stored stacked together at an elevated height. The suspended rack can drop down by a lowering mechanism to a height amenable to access. The boards will space out evenly from adjacent boards in a sequential top to bottom manner upon descent.

The invention includes dual rack units for the storage of multiple sports board units. The dual rack units may be a parallel stanchion construction with removable, equally spaced reinforced horizontal support unit sections. The number of these support unit sections preferably corresponds with the number of items being stored. The dual nature of the rack corresponds to a pair of rack constructions horizontally spaced to provide contact points in the forward and rear region of the stored items. In an extended state the successive racks will be evenly spaced with ample room for placement and removal of the stored item. Raising the rack unit back into storing position will eliminate the space between successive boards from the bottom up.

The lifting mechanism will have its origin in a support frame fixed superior or upper to the rack mechanism to ceiling rafters. Built into the frame will be a pulley system to lift and lower the rack unit. The frame will also include the mounting points for each of the two rack units and robust fastening areas to allow for variability in mounting distances between suitable structural supports.

A lower support frame also comprises the lifting apparatus. This frame will be located inferior to, and create, the lifting point and lowest storage point on the rack units. This lower frame provides mitigation of sway or horizontal displacement changes between the pair of rack units while also housing the lower pulley components of the lifting mechanism. Additionally, this lower rack system frame will provide the upper support structure of an accessory storage compartment.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
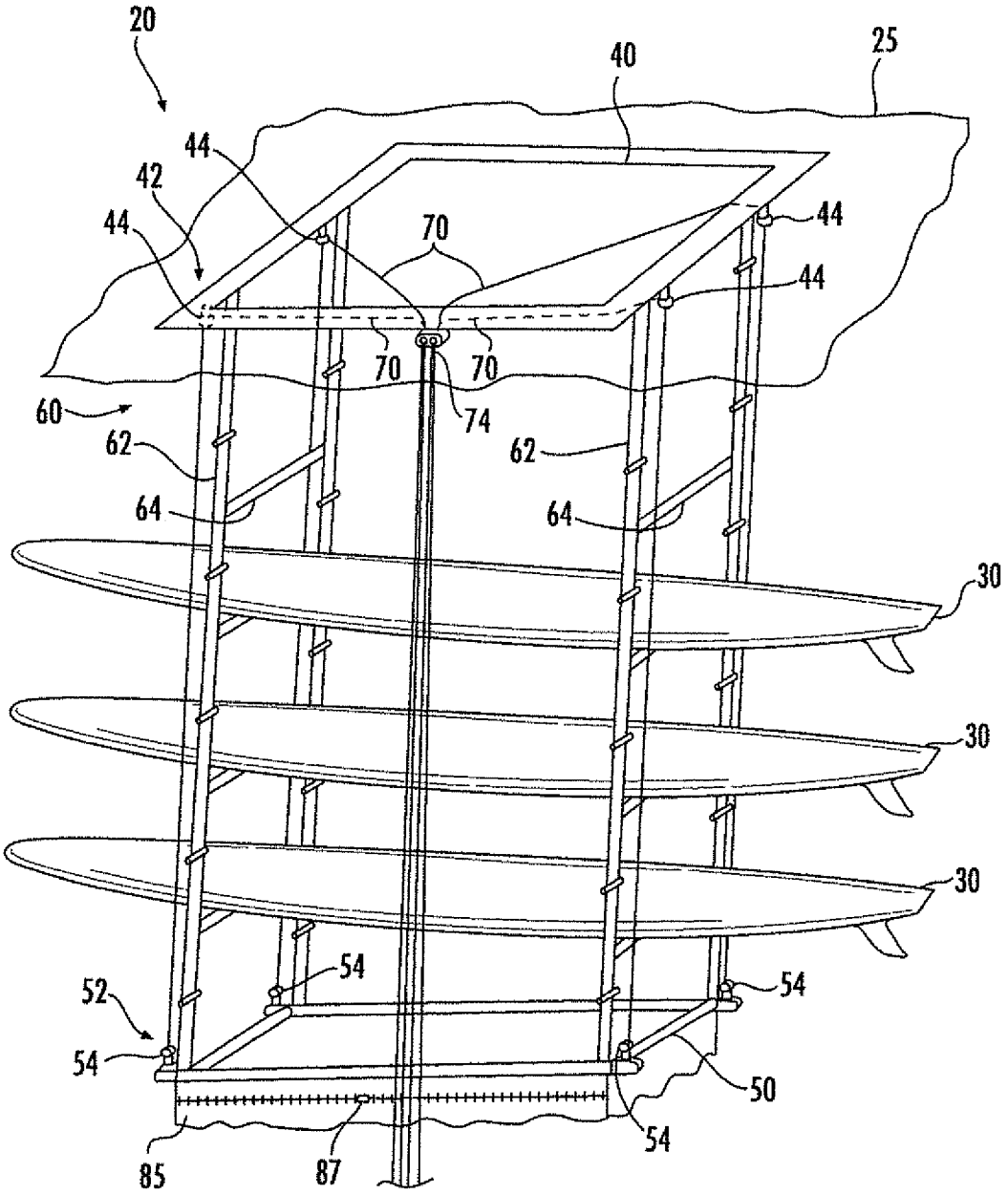
FIG. 1 is a perspective view of a sports board rack system supporting multiple surfboards in an expanded position in accordance with the present invention.
Figure 2:
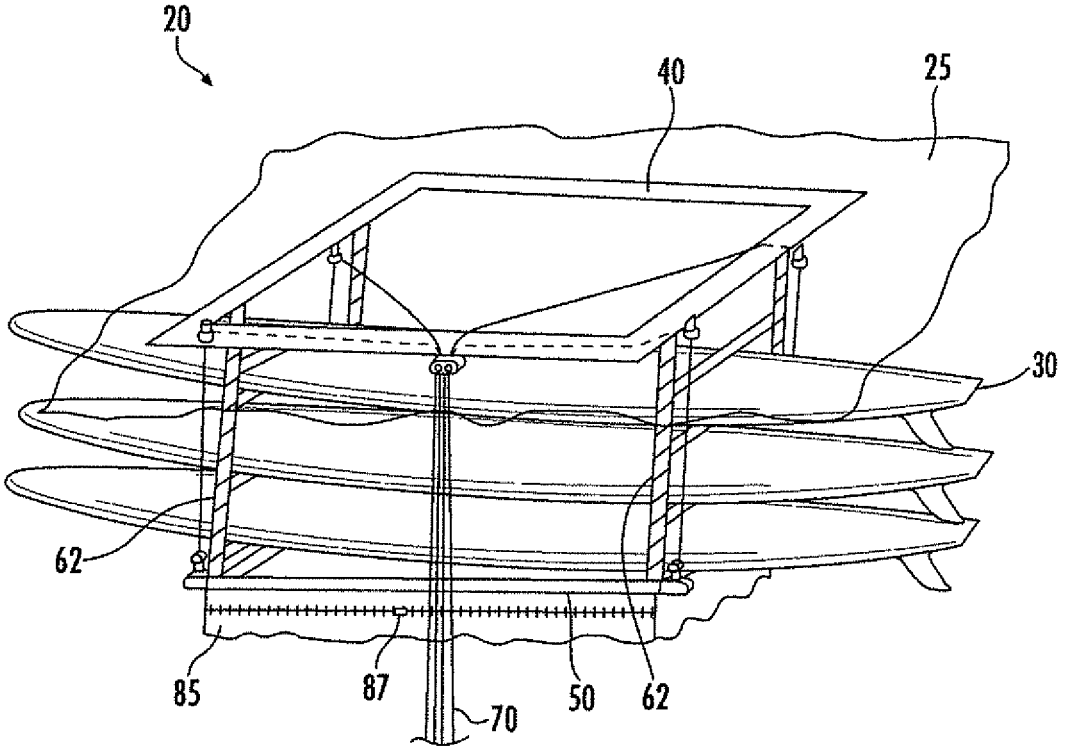
FIG. 2 is a perspective view of the sports board rack illustrated in FIG. 2 in a retracted or stored position.

Referring initially to FIGS. 1 and 2, a sports board rack 20 for storing sports boards 30 includes a rigid upper support frame 40 to be mounted to a ceiling 25, a rigid lower support frame 50, and a flexible rack assembly 60 extending between the upper and lower support frames. The flexible rack assembly 60 aligns the lower support frame 50 with the upper support frame 40.

The flexible rack assembly 60 includes a pair of spaced apart rack units 62. Each rack unit 62 includes a plurality of spaced apart board supports 64 to accommodate a plurality of sports boards 30 in a horizontal position.

An upper pulley arrangement 42 is coupled to the upper support frame 40, and a lower pulley arrangement 52 is coupled to the lower support frame 50. The upper and lower pulley arrangements 42, 52 include cords 70 used to move the flexible rack assembly 60 between an expanded position and a retracted position.

The cords 70 are held in place by guides carried by the upper support frame 40. The guides may be internal or external the upper support frame 40. When the guides are internal the upper support frame 40, the cords 70 on the backside of the pulley arrangement 42 are routed within the upper support frame to the frontside of the pulley arrangement. The cords are then directed to a common location. In the illustrated example, a cord locking mechanism 74 is at the common location to hold and release the cords 70 in a desired position.

Alternatively, a cord collection eyelet is at the common location to collect the cords and direct them to an external cord locking mechanism 74. The external cord locking mechanism 74 is wall mounted and may be configured as an I-hook, for example. The cords 70 will have at least one cleat associated therewith for securing to the I-hook so as to hold the flexible rack assembly 60 in a desired position.

When the flexible rack assembly 60 is in the expanded position, as shown in FIG. 1, the board supports 64 are evenly spaced for placement and removal of the sports boards 30 in a horizontal direction, with an ample separation distance between adjacent sports boards. When the flexible rack assembly 60 is in the retracted or stored position, as shown in FIG. 2, the board supports 64 are moved closer to one another so that the separation distance between adjacent sports boards 30 in the vertical direction is reduced.

The sports board rack 20 advantageously allows sports boards 30 to be stored at an elevated height so as to still maintain use of the space below. To retrieve or store a sports board 30, the flexible rack assembly 60 is lowered to a height that may be easily accessible. The illustrated sports board 30 is a surfboard. Other types of sports boards may be carried by the sports board rack 20, such as wakeboards, wakeboards, water skis and snow skis, for example.

Figure 3:
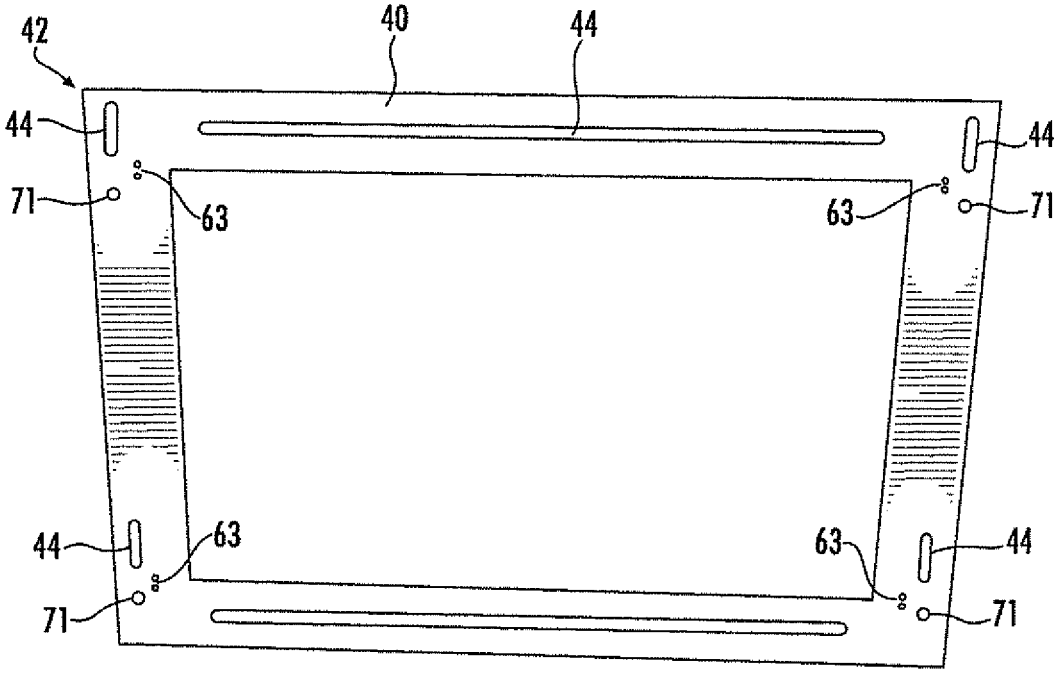
FIG. 3 is a plane view of the upper support frame illustrated in FIG. 1.

The upper support frame 40 is rectangular shaped, as illustrated in FIG. 3. The upper support frame 40 is used to fasten the sports board rack 20 to an existing or retrofitted support structure of a building. The upper support frame 40 includes slots 44 to provide robust installation and fastening in an overhead position, such as to rafters, for example. If the ceiling rafters are not appropriately centered or spaced with respect to a desired installation area, then a pair of L-shaped wall brackets may be used. One leg of the bracket is mounted to a wall stud, and the other leg allows the upper support frame 40 to be attached thereto. The upper support frame 40 carries the upper pulley arrangement 42, which includes a pulley 44 at each corner.

Figure 4:
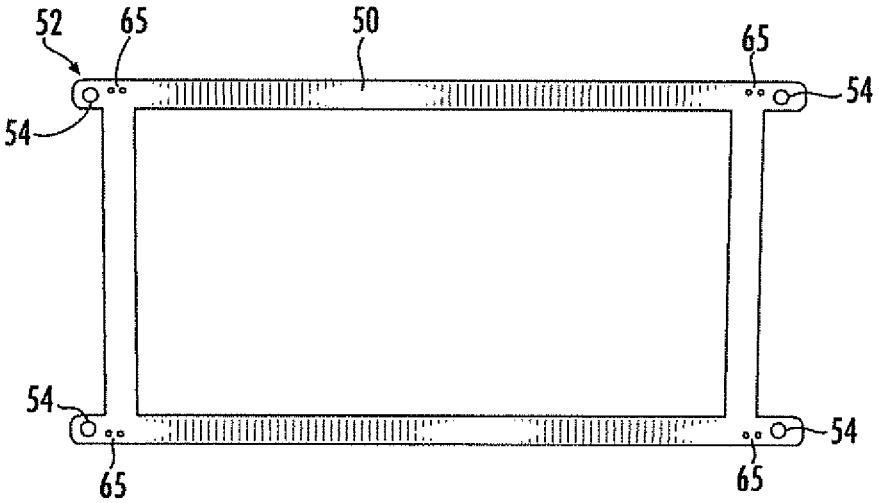
FIG. 4 is a plane view of the lower support frame illustrated in FIG. 1.

The lower support frame 50 is also rectangular shaped, as illustrated in FIG. 4. The lower support frame 50 has a storage bag 85 attached thereto for storage of smaller sized sports board related equipment or parts. The illustrated storage bag 85 includes a zipper 87 used to open and close the storage space. As an alternative to a zipper, hook and loop fasteners may be used, for example. In addition, the storage bag 85 and the lower support frame 50 may be integrated as a single unit. The lower support frame 50 carries the lower pulley arrangement 52, which includes a pulley 54 at each corner.

A fixed end of each respective cord 70 is secured to the upper support frame 40 adjacent a pulley 44, as indicated by reference 71. Depending on how the cords 70 are routed, a portion of the pulleys 44, 54 may be swivel pulleys. The illustrated cords 72 are routed through the upper pulleys 44 to the lower pulleys 54 and back to the upper pulleys. A free end of each respective cord 70 is directed to the cord locking mechanism 74, as illustrated in FIG. 1, or to a wall anchoring system, for example. The cord locking mechanism 74 may also be configured to include a motor to assist with moving the sports board rack 20 between the expanded position and the retracted position.

Alternatively, an all inclusive pulley and rope attachment configuration may be used, as readily appreciated by those skilled in the art. In this configuration, the pulley and rope attachments may be internal the upper and lower support frames 40, 50.

The pair of spaced apart rack units 62 are secured to the upper support frame 40 at location 63. Similarly, the pair of spaced apart rack units 62 are attached to the lower support frame 50 at location 65. Attachment of the rack units 62 to the respective upper and lower support frames 40, 50 may be such to allow easy removal and replacement of the rack units 62.

In the present embodiment, the flexible rack assembly 60 is raised and lowered manually through a rope and pulley system. However, other optional approaches includes pulley or axle driven mechanics may be used, for example. Operation of the mechanics may be manual or power assisted.

From the upper, compressed stored position, the flexible rack assembly 60 can be lowered by releasing the drive rope from a secured position. As the descent progresses, the stored items will become separated by a distance equal to the length of the rack unit from the surrounding rack units in a successive manner from top to bottom. The reverse holds true for ascent toward the stored position through pulling the drive rope back through the pulley system.

Figure 5:
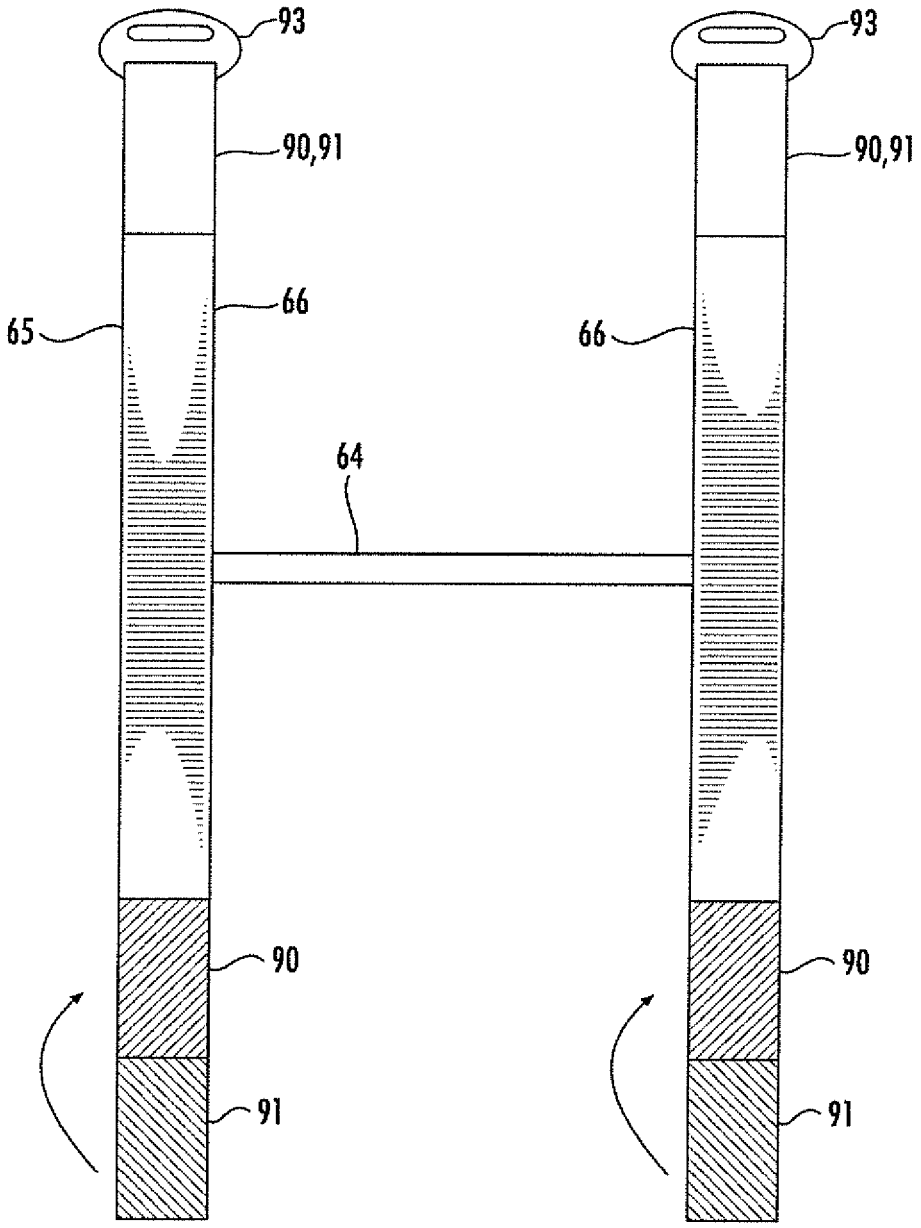
FIG. 5 is a planar view of a modular rack unit section of the flexible rack assembly illustrated in FIG. 1.

Each rack unit 62 is composed of individual modular rack unit sections 65 coupled together. The modular rack unit sections 65 are tiered and mounted preferably in a parallel fashion at opposing ends, or along the length or width of the upper frame unit. Isolated individually, in hanging position, each modular rack unit sections 65, with the exception of the first, resembles a squat upper case letter "H", as illustrated in FIG. 5.

Starting at the upper frame unit, the upper vertical components of the first rack unit section would be longer than the subsequent ones to allow for customization of lowered rack position height from the mount frame to suit both the structural demands of the mounting location and also personal preference. This length may be 3 feet, for example.

Each modular rack unit sections 65 comprises spaced apart straps 66 with at least one board support 64 extending therebetween, and are attached to one another by a reversible fastening method, such as with a hook 90 and loop 91 fastener with webbing slides or buckles 93. The hook 90 and loop 91 fastener from an adjacent modular rack unit section 65 are coupled to the respective buckles 93. This coupling arrangement is for illustration purposes and is not to be limiting.

Each rack unit 62 includes a desired number of repeating modular rack unit sections 65, and is preferably symmetrically at both ends. The rack units 62 culminate at the lowest point with attachment to the lower support frame 50. The lower support frame 50 is coupled to a bottom storage bag 85, which serves as a possible attachment point for accessory storage, and houses the lower pulley system while keeping the independent rack systems together horizontally.

Each modular rack unit sections 65 is preferably constructed with a rigid cross member occupying the horizontal position of support for stored items. At distal ends of this horizontal cross member, the vertical component, composed of webbing and attached hook and loop fasteners, of the modular rack unit sections emanates in both the up and down directions and serves as attachment points to the upper and lower support frames 40, 50. Attachment in this embodiment is accomplished by folding the hook to loop fasteners 90, 91 through the webbing slides or buckles 93 between successive or adjacent rack units.

Although the preceding description contains specific and significant detail, it should not be construed as limiting the scope of the invention, but rather providing an example of possible embodiments of the invention. As an example, the sports board rack system could take many different forms. A plausible alternative would be to construct the entire sports board rack system out of a long central slide rope (lifting mechanism) encased within a larger hollow rope that would create attachment points for the horizontal supporting cross beam members while serving as the determinants of the vertical spacing between successive racks. Such a variation would not materially alter the functional nature of the invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the foregoing description.

That which is claimed:

1. A sports board rack system comprising:

an upper support frame;

an upper pulley arrangement adjacent an underside of said upper support frame;

a lower support frame;

a lower pulley arrangement carried by said lower support frame;

a plurality of cords having respective first ends coupled to said lower pulley arrangement, respective mid-sections extending from the first ends and in contact with said upper pulley arrangement, and second ends extending from the mid-sections and grouped together at a common area adjacent said upper support frame;

a flexible rack assembly coupled between said upper and lower support frames and comprising a pair of spaced apart rack units, with each rack unit comprising a plurality of modular rack unit sections coupled together, with each modular rack unit section comprising spaced apart straps with at least one board support extending therebetween; and said flexible rack assembly being moveable between an expanded position and a retracted position, when in the expanded position the plurality of board supports are aligned with one another in a horizontal direction for placement and removal of sports boards, and when in the retracted position the plurality of board supports are moved closer to one another so that a separation distance between adjacent board supports in a vertical direction is reduced, with each sports board resting on a respective pair of board supports aligned with one another in the horizontal direction.

2. The sports board rack system according to claim 1 wherein each modular rack unit section further comprises fasteners at upper and lower ends of each strap for coupling with an adjacent modular rack unit section.

3. The sports board rack system according to claim 2 wherein said fasteners comprise at least one of hook and loop fasteners and buckle fasteners, with the hook and loop fasteners being coupled to the buckle fasteners of an adjacent modular rack unit section.

4. The sports board rack system according to claim 1 wherein said upper and lower pulley arrangements are internal said respective upper and lower support frames.

5. The sports board rack system according to claim 1 wherein said upper pulley arrangement comprises a plurality of upper pulleys and said lower pulley arrangement comprises a plurality of lower pulleys, and wherein said plurality of cords extend said plurality of upper and lower pulleys.

6. The sports board rack system according to claim 1 further comprising a cord locking mechanism for holding and releasing said plurality of cords so that said flexible rack assembly is moveable between the expanded and retracted positions.

7. The sports board rack system according to claim 6 wherein said cord locking mechanism is carried by said upper support frame.

8. The sports board rack system according to claim 6 wherein said cord locking mechanism comprises a motor to assist in moving said flexible rack assembly between the expanded and retracted positions.

9. The sports board rack system according to claim 1 wherein said upper and lower support frames are rectangular shaped.

10. The sports board rack system according to claim 1 further comprising a storage bag carried by said lower support frame.

11. The sports board rack system according to claim 10 wherein said storage bag and said lower support frame are integrated together as a single unit.

12. A sports board rack system comprising:

a rectangular shaped upper support frame to be mounted to an overhead structure;

an upper pulley arrangement adjacent an underside of said upper support frame;

a rectangular shaped lower support frame;

a lower pulley arrangement carried by said lower support frame;

a plurality of cords having respective first ends coupled to said lower pulley arrangement, respective mid-sections extending from the first ends and in contact with said upper pulley arrangement, and second ends extending from the mid-sections and grouped together at a common area adjacent said upper support frame;

a flexible rack assembly coupled between said upper and lower support frames and comprising a pair of spaced apart rack units, with each rack unit comprising a plurality of modular rack unit sections coupled together, with each modular rack unit section comprising spaced apart straps with at least one board support extending therebetween; and said flexible rack assembly being movable between an expanded position and a retracted position so that in the expanded position the plurality of board supports are aligned with one another in a horizontal direction for placement and removal of sports boards, and in the retracted position the plurality of board supports are moved closer to one another so that a separation distance between adjacent board supports in a vertical direction is reduced, with each sports board resting on a respective pair of board supports aligned with one another in the horizontal direction.

13. The sports board rack system according to claim 12 wherein each modular rack unit section further comprises fasteners at upper and lower ends of each strap for coupling with an adjacent modular rack unit section.

14. The sports board rack system according to claim 12 wherein said upper and lower pulley arrangements are internal said respective upper and lower support frames.

15. The sports board rack system according to claim 12 wherein said upper pulley arrangement comprises a plurality of upper pulleys and said lower pulley arrangement comprises a plurality of lower pulleys, and wherein said plurality of cords extend said plurality of upper and lower pulleys.

16. The sports board rack system according to claim 12 further comprising a cord locking mechanism for holding and releasing said plurality of cords so that said flexible rack assembly is moveable between the expanded and retracted positions.

17. The sports board rack system according to claim 12 further comprising a storage bag carried by said lower support frame.

* * * * *